US007178469B2

(12) United States Patent
Goza

(10) Patent No.: US 7,178,469 B2
(45) Date of Patent: Feb. 20, 2007

(54) RETRACTABLE MULTIPOSITION FURNITURE SYSTEM

(76) Inventor: Roger Goza, P.O. Box 690371, Houston, TX (US) 77269

( * ) Notice: Subject to any disclaimer, the term of this patent is extended or adjusted under 35 U.S.C. 154(b) by 349 days.

(21) Appl. No.: 10/633,140

(22) Filed: Aug. 1, 2003

(65) Prior Publication Data

US 2005/0022699 A1 Feb. 3, 2005

Related U.S. Application Data

(60) Provisional application No. 60/446,722, filed on Feb. 10, 2003.

(51) Int. Cl.
*A47B 37/00* (2006.01)

(52) U.S. Cl. ..... 108/50.01; 312/223.3

(58) Field of Classification Search ..... 108/50.01, 108/50.02, 23, 1, 9, 4; 312/223.6, 223.5, 312/223.3, 223.1
See application file for complete search history.

(56) References Cited

U.S. PATENT DOCUMENTS

| | | | | |
|---|---|---|---|---|
| D247,811 | S | 5/1978 | Moeckl | |
| D280,100 | S | 8/1985 | Ungar | |
| D280,722 | S | 9/1985 | Selke | |
| D282,421 | S | 2/1986 | Lewellen et al. | |
| 4,766,422 | A * | 8/1988 | Wolters et al. | 312/223.3 |
| D330,301 | S | 10/1992 | Ugalde | |
| D335,786 | S | 5/1993 | Garvey et al. | |
| D339,250 | S | 9/1993 | Risom et al. | |
| D344,932 | S | 3/1994 | Berkowitz et al. | |
| 5,321,579 | A * | 6/1994 | Brown et al. | 312/223.3 |
| D354,182 | S | 1/1995 | Abraham et al. | |
| 5,437,235 | A * | 8/1995 | Randolph | 312/223.3 |
| 5,450,800 | A * | 9/1995 | Leonard | 312/223.3 |
| 5,568,773 | A * | 10/1996 | Hung | 108/50.02 |
| 5,588,727 | A * | 12/1996 | D'Agaro et al. | 312/223.3 |
| 5,746,489 | A * | 5/1998 | Moon | 312/223.3 |
| D434,578 | S | 12/2000 | Goza | |
| D435,361 | S | 12/2000 | Goza | |
| D435,362 | S | 12/2000 | Goza | |
| D440,424 | S | 4/2001 | Goza | |
| 6,712,008 | B1 * | 3/2004 | Habenicht et al. | 108/50.01 |
| 6,712,433 | B2 * | 3/2004 | Hellwig et al. | 312/223.6 |

FOREIGN PATENT DOCUMENTS

EP 481159 A1 * 4/1992

OTHER PUBLICATIONS

Dectron (Marked Exhibit "A", pp. 1-4) Proximity Systems Retractable Workstation.

* cited by examiner

*Primary Examiner*—Jose V. Chen
(74) *Attorney, Agent, or Firm*—C. James Bushman; Browning Bushman P.C.

(57) ABSTRACT

A workstation providing multiple presentation angles for a visible display structure and a related working area structure. The display and working structures are adjustably mounted on a cabinet pedestal that houses electronic equipment connected with components carried by the display and working area structure. The cabinet pedestal is positioned against a wall below gauges and/or other materials mounted on the wall. When not being used, the working area structure closes over the visible display structure to provide a decorative cover over an enclosed area. The display and work structures are retractable to a compact standby position at the top of the cabinet, leaving certain of the wall-mounted materials visible over the top of the stored workstation. A recess provided between the back of the stored display and work structure accommodates certain wall mounted materials.

27 Claims, 4 Drawing Sheets

FIG. 2
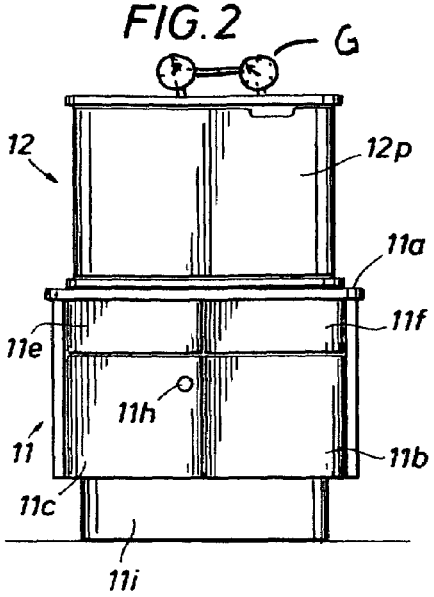
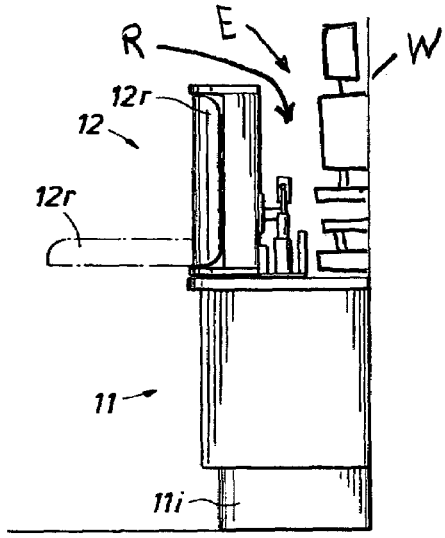
FIG. 3
FIG. 4
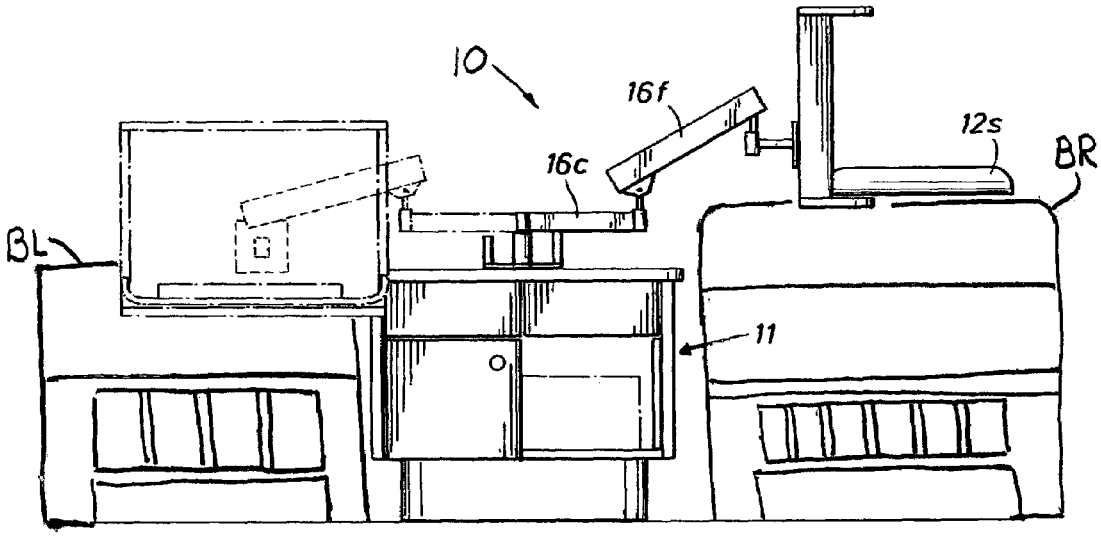

RETRACTABLE MULTIPOSITION FURNITURE SYSTEM

CROSS-REFERENCE TO RELATED APPLICATIONS

This application claims the benefit of U.S. Provisional Application Ser. No. 60/446,722 filed Feb. 10, 2003.

BACKGROUND OF THE INVENTION

1. Field of the Invention

The present invention relates to special purpose furniture that can be adjusted to accommodate differently situated users.

2. Description of Related Prior Art

Wall mounted workstations that can be opened for use and subsequently folded back up when not in use have commonly been employed for providing a retractable visual presentation area and work surface. Such workstations sometimes contain a computer monitor in the visual presentation area and a keyboard on the work surface. When not in use, the workstation is retracted by being folded together to assume a compact, closed cabinet-like container against the wall upon which it is mounted. These workstations are particularly useful in medical facilities where doctors and technicians can conveniently access a computer workstation associated with a laboratory, a patient's room or other special area within the medical facility. Once the short-term task has been accomplished, the workstation can be folded up to return to its compact storage position.

A retractable workstation of the described type would be particularly desirable between two adjacent beds in a semi-private hospital room. However, conventional wall mounted workstations cannot be conveniently mounted on the wall between such beds because of the usual presence on the wall of equipment used to administer oxygen and monitor the patients' vital signs.

Counterbalanced, adjustable arms are often employed to position lights, materials, instruments, monitoring equipment or display equipment or other devices (herein referred to inclusively as "presentation material") at a desired angle and/or height. Such adjustable arms have typically been mounted on a wall or on a movable pedestal that contains equipment or materials associated with the presentation materials mounted at the end of the arm. Equipment and materials of this latter type are usually arranged such that the control or data signals associated with the presentation materials are manually entered from a workstation that is a stationary part of the pedestal.

Many of the counterbalanced adjustable arm systems are designed for use by a single person who does not require that the display or monitoring function of the presentation material be visually evident while the control or data entry function is being performed. The use of such conventional equipment by a single user who must visualize a display while simultaneously entering data or controls reflected in the display can be difficult. The problem can be exacerbated when the same unit of equipment is to be used by different individuals, in different environments and with different physical requirements.

SUMMARY OF THE INVENTION

A preferred form of the invention provides a system of furniture in which a retractable workstation is mounted from a pedestal support at the end of an adjustable, articulated arm. The workstation can be opened to provide access to a visual presentation area and to present a work surface for a standing, seated or reclining user. The retractable workstation can be extended away from the pedestal support to a variety of different positions and orientations as required to accommodate the needs of the user.

When not being used, the workstation can be retracted to form an enclosed compartment that can be nested against the pedestal support. A recess is provided behind the nested workstation to accommodate oxygen and monitoring equipment that may be mounted on the wall directly behind the workstation. Gauges and other monitoring equipment on the wall are visible over the top of the nested workstation. When mounted between two beds in a hospital room, the workstation can be positioned for use by a physician or other attendant or for use by the occupant of either bed.

The top and bottom of the presentation support structure includes panels that extend away at right angles to cooperate with sidewalls that extend away at right angles from the work support structure to form an enclosed storage cabinet when the work support structure is retracted into position against the presentation support structure. In applications that require temporary or intermittent use of the workstation while the workstation has been adjusted to a specific position or orientation relative to an immobile user, for example, a bedridden patient, the working area of the workstation can be closed up against the presentation area of the workstation to minimize the space occupied by the workstation when it is not being used. In these applications, the workstation is left in its extended position with the work support structure retracted, forming an attractive closed cabinet occupying a minimum of space. When the workstation is again needed, it can be easily accessed by the unassisted user.

In its broader aspects, the present invention provides a system of furniture in which a segment of the furniture that is designed to provide a presentation support structure is combined with a work support structure that is associated with the presentation support structure. The presentation support structure may carry, for example, a visual display, a chalkboard, an optical instrument or other device or material. The work support structure may provide, for example, a flat writing surface, a tray, a storage counter, a food preparation surface, a keyboard or other data entry equipment. As herein used, the term "workstation" is intended to include the presentation support structure and the work support structure, without regard to the specific material or equipment carried by the presentation support structure or the work support structure.

The two structure segments forming the workstation are mounted on a support pedestal and made adjustable relative to each other and to the support pedestal. The support pedestal may house an associated component of the material or equipment that is carried by the presentation support structure and/or the work support structure.

The work support structure of the workstation has a working side and an ornamental side. By suitably adjusting the work support structure relative to the presentation support structure, the ornamental side replaces, or overlays, the presentation support structure from the perspective of the user of the furniture. Placing the work support structure against the presentation support structure also minimizes the external dimensions of the furniture system, making it more compact, when the system is not being used. The sides on the work support structure and the top and bottom top panels on the presentation support structure, in addition to completing a cabinet-like enclosure for the retracted workstation, are provided with ornamental exterior surfaces that coordinate with the visible surfaces of the retracted workstation.

The workstation, comprising a composite assembly provided by the work support structure and the presentation support structure, is preferably carried by a counterbalanced, adjustable arm system that permits the assembly to be adjusted through a wide range of positions, orientations and inclinations. The viewing angle, work surface presentation angle, height, position and orientation of the workstation structures can be adjusted as required to accommodate a standing, sitting, reclining or otherwise positioned user.

The multi position workstation is mounted on a support pedestal that provides a lockable housing for equipment and or other material which, for example, may be associated with the work support structure or the appliance or instruments of the presentation support structure. The pedestal may be attached to a wall or other structure or may be mounted on rollers or other means to facilitate changing the location of the furniture system.

When positioned between adjacent beds, the furniture system can be adjusted to accommodate the requirements of the occupant of either bed. A physician or other person needing to access the furniture system from between the beds can adjust the presentation and work structures as required for standing or sitting access. Equipment on the wall behind the retracted, nested furniture system is accommodated in a recess formed behind the workstation. Gages and instruments on the wall are visible over the nested workstation.

When used in the office of a dentist or other service provider attending to a seated person, the workstation of the furniture system can be adjusted to provide visual displays and/or a working surface for the seated user as well as the service provider. When not in use, the workstation may be retracted and nested against its cabinet mount at a position that does not interfere with the provision of the services.

From the foregoing, it may be appreciated that a primary object of the present invention is to provide an attractive furniture system that can be adjusted to meet the requirements of a wide range of users.

Another object of the present invention is to provide a furniture system that allows presentation material and working areas of the furniture to be adjusted as required to meet the requirements of a standing, sitting or reclining user.

It is also an object of the present invention to provide a system of furniture in which an assembly of a working support structure and a presentation support structure are combined with a mounting structure such that each of the structures is adjustable relative to the other to provide optimal user facility and to be retractable and nestable to a compact storage condition.

It is a further object of the present invention to provide a lockable pedestal cabinet mounting an adjustable, counterbalanced arm that supports a folding, presentation and work structure for use by variously situated users.

An object of the present invention is to provide a compact, adjustable furniture system mounted on a cabinet pedestal for providing an adjustable assembly of a work surface and a presentation area wherein the work surface can be folded up to the presentation area to form a cabinet-like enclosure and the assembly can be positioned directly over the cabinet pedestal for storage.

An important object of the present invention is to provide a pedestal cabinet connected by an adjustable arm to a retractable workstation.

It is also an important object of the present invention to provide a pedestal cabinet secured to a building wall, connected by an adjustable, multi-position arm to a retractable workstation wherein the workstation can be retracted from its open working configuration to form an enclosed cabinet and wherein the retracted workstation can be moved through the adjustable arm and nested atop the pedestal cabinet in a position that accommodates equipment mounted on the building wall without obscuring monitoring devices on the wall.

The foregoing objects, features and advantages of the present invention, as well as others, will be more fully understood and better appreciated by reference to the following drawings, specification and claims.

BRIEF DESCRIPTION OF THE DRAWINGS

FIG. 2 is a vertical elevation of the furniture system of the present invention as it appears when retracted and nested in standby position against a hospital wall;

FIG. 3 is a side elevation of the furniture system of FIG. 2 illustrating the work surface structure (in dotted line) in open position;

FIG. 4 is a front elevation, in solid line and dotted line, illustrating the furniture system of the present invention as it appears in different adjusted positions between adjoining beds in a hospital room;

DESCRIPTION OF THE ILLUSTRATED EMBODIMENTS

Figure 1:
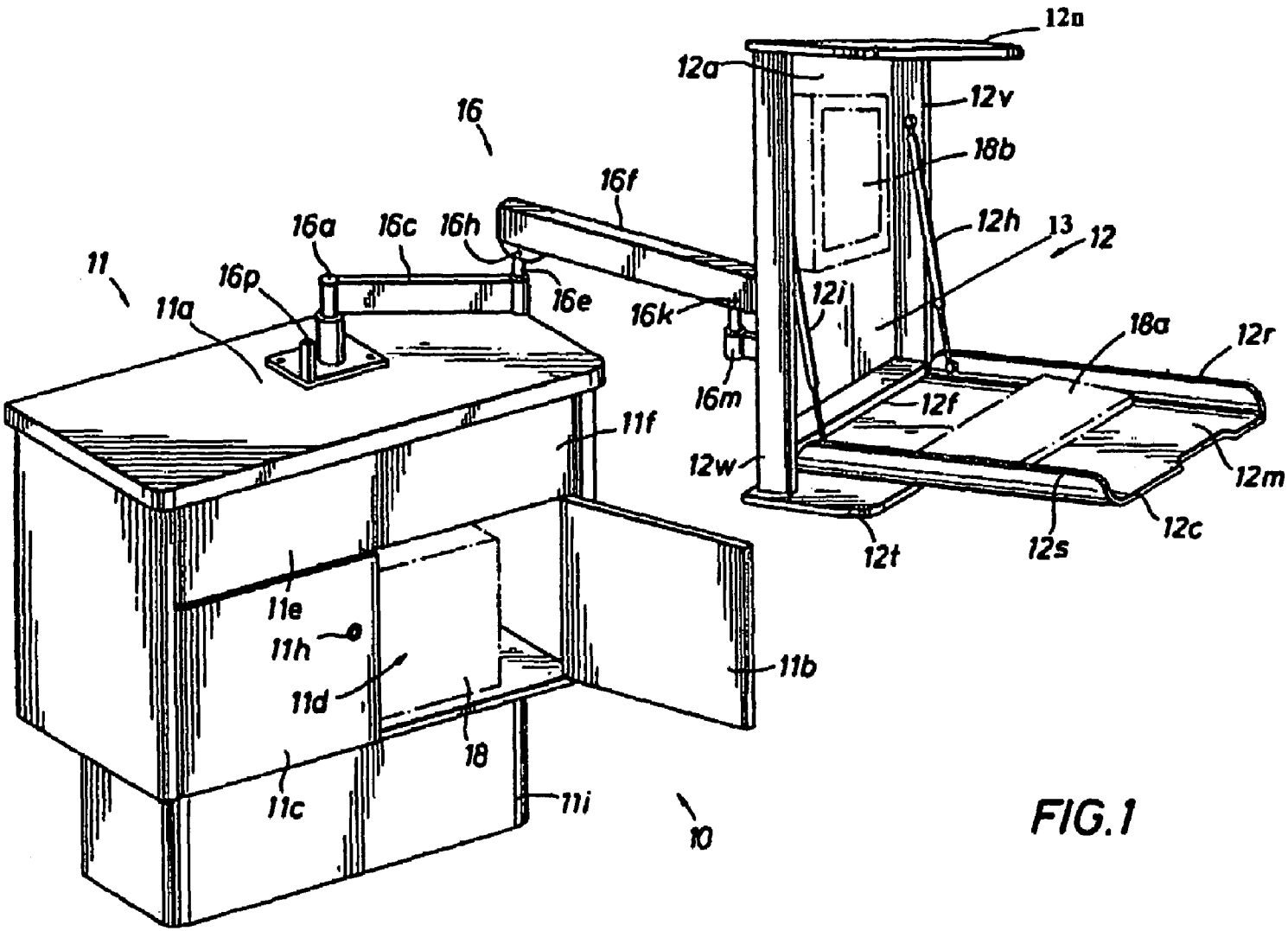
FIG. 1 is a perspective view illustrating a cabinet pedestal mounted adjustable furniture system of the present invention.

The furniture system of the present invention is indicated generally at 10 in FIG. 1. The system 10 includes a cabinet pedestal mount indicated generally at 11 and a workstation comprising a visual and work area presentation assembly indicated generally at 12. The workstation 12 is adjustably mounted on the cabinet pedestal 11 by a counterbalanced arm assembly indicated generally at 16. The arm assembly 16 is bolted or otherwise suitably secured to a top 11*a* of the cabinet pedestal 11. The external surfaces of the furniture system 10 are preferably provided with a decorative coating or layer of decorative material to achieve a desired furniture appearance.

The arm assembly 16 may be any suitable assembly that provides the desired degree of flexibility and adjustability for the workstation 12. The arm 16 is constructed of metal, with pivoting mounts, spring biasing elements and clamping components that provide the desired range of adjustable movements. Such arm assemblies suitable for use with the present invention are of the type manufactured, for example, by Special-T Shop Mfg., Inc. under the trademark Dec-Tron®.

The arm assembly 16 includes a first revolving mount 16*a* that supports a connected arm section 16*c* for 360 degree rotation in a horizontal plane. A second revolving mount 16*e* secures a second arm section 16*f* for 360 degree rotational movement about the end of the arm segment 16*c*. The arm segment 16*f* is pivotably mounted at 16*h* to the top of the revolving mount 16*e*. The pivotal mount 16*h* permits a limited range of rotation in a vertical plane about the rotational mount 16*e*. The rotary mount 16*m* is bolted or otherwise suitably secured to the workstation 12.

In one form of the invention, a mount 16*k* at the end of the rotating mount 16*m* pivotably supports the workstation 12 for a wide range of adjustments about a horizontal axis in a vertical plane. In another form of the invention, the mount 16*k* and the adjustable arm assembly 16 maintain the engaged structure of the workstation 12 in a substantially vertical orientation regardless of the vertically adjusted position of the workstation. This latter version of the invention maintains the extended work surface of the work support structure in a substantially horizontal plane regardless of the vertical position to which the workstation 12 has been moved.

The cabinet pedestal mount 11 includes cabinet doors 11*b* and 11*c* that are hinged at their ends to open and close an internal cabinet area 11*d*. Drawers 11*e* and 11*f* slide into and out of the cabinet in a conventional manner. Locks, such as the lock 11*h*, may be provided as desired for any of the doors or drawers in the cabinet pedestal 11. A foot section 11*i* provides a decorative base for the furniture system 10. Equipment such as a computer-processing unit (CPU) 18, indicated in dotted line, may be housed in the cabinet 11.

The workstation 12 includes a presentation support structure 12*a* and a work support structure 12*c*. The rear of the work support structure 12*c* is hinged at 12*f* to permit the structure 12*c* to be retracted or folded into a storage position against the presentation support structure 12*a*. Pneumatic cylinders 12*h* and 12*i* dampen the opening and closing folding movement of the work support structure 12*c*. The cylinders 12*h* and 12*i* also provide a closing bias force that prevents the work support structure 12*c* from moving out of its retracted storage position until it is pulled open by the user.

The work support structure 12*c* includes a work side surface 12*m* that can provide a platform or base for a computer keyboard (indicated in dotted line) 18*a* or other manually operated input device or instrument. Any desired device may be permanently secured or temporarily rested upon the work side surface 12*m*.

As is best illustrated in FIG. 2, the side opposite the work side surface 12*m* includes an ornamental side 12*p* that is visible when the workstation 12 has been retracted into its storage configuration. The surface of the work support structure side 12*p* may be a continuous veneer of wood, an artificial wood grain covering, a uniform steel or synthetic material covering or other suitable ornamental surfacing consistent with the intended use of the furniture system. The surface of the ornamental side 12*p* preferably coordinates with the remainder of the visible workstation surfaces and the visible portions of the cabinet pedestal.

Referring jointly to the various figures, side retention panels12*r* and 12*s* deflect away from the primary work surface 12*m* to provide pivoting end supports for the pneumatic cylinders 12*h* and 12*i*. The side retention panels12*r* and 12*s* also retain materials on the work surface 12*m* while their external surfaces present an ornamental side view to the retracted workstation.

The presentation support structure 12*a* supports a slim-line, flat screen computer monitor (indicated in dotted line) 18*b* that is connected with the CPU 18 and the keyboard 18*a*. Any wiring or other accessories necessary to communicate the various components housed in the cabinet pedestal 11, or carried on the work surface 12*m* or mounted on the presentation support structure 12*a* are preferably deployed behind false panels, tubing, arm channels and other conventional distribution devices to provide a clean, uncluttered presentation.

The presentation support structure 12*a* includes a top header panel 12*n*, a bottom shelf 12*t*, and side panels 12*w* and 12*v*. The top side panels 12*v* and 12*w* provide pivoting support for the pneumatic cylinders 12*h* and 12*i* and, like the work support structure panels 12*r* and 12*s*, provide ornamental side covers for the retracted workstation 12.

The bottom shelf 12*t* provides structural support for the work support structure 12*c* when the structure is in its open position, as illustrated in FIG. 1, and serves as a symmetrical offset to the top header panel when the structure is in its retracted storage position, as illustrated in FIG. 3. A presentation area 13 is formed between header panel 12*n* and bottom shelf 12*t*. The top and side extensions of the presentation support structure 12*a* cooperate with the work support structure side extensions 12*r* and 12*s* to form a cabinet-like enclosure that completely encases the monitor and keyboard of the retracted workstation in the presentation area 12. As thus configured, it will be appreciated that the workstation 12, carried at the end of the adjustable arm assembly 16, can be retracted to form an enclosed housing for containment of the equipment or materials within the workstation while simultaneously acting as a cabinet-like furniture component whose visible external surfaces have an ornamental furniture finish.

FIG. 3 illustrates the furniture system 10, rigidly attached to a hospital wall W. The workstation 12 of the furniture system is retracted and nested into its storage or standby positioned atop the pedestal cabinet mount 11. To place the system 10 into this configuration, the workstation 12 is moved rearwardly against a backstop 16*p* and downwardly such that the shelf 12*t* rests on the top of the cabinet pedestal top 11*a*. When the workstation is resting against the backstop 16*p*, a recess R is formed behind the nested furniture system 10 and the wall W. The workstation's movement to its nested position is accommodated by the various pivoting and rotating connections of the arm assembly 16. The work support structure 12*c* is retracted from the dotted line open position illustrated in FIG. 3 to the solid line, closed position to fully retract the furniture for storage. In the retracted position, the ornamental side 12*p* of the workstation 12 covers over and encases the flat screen monitor 18*b* and presents a decorative furniture surface.

An important feature of the present invention is its ability to be positioned in its nested, or standby storage position producing the recess R such that wall mounted equipment, indicated generally at E in FIG. 3, is accommodated behind the nested workstation. As evident in FIG. 2, gauges G indicating the status of oxygen pressure, pulse rate or other monitored function, are situated above the nested furniture system 10 so that they are readily visible to an attendant.

FIG. 1 of the Drawings illustrates the furniture system 10 of the present invention substantially as it would appear when being presented to a seated person or a person of relatively short stature. The work surface 12*m* is in a substantially horizontal plane and the presentation surface 12*a* is in a substantially vertical plane, at right angles to the work surface. In this configuration, the user has an optimum visual perspective relative to the content of the presentation area while the working area is simultaneously accessible for manual activity, such as keyboard operation or note taking.

FIG. 4 illustrates alternative horizontal and vertical positions of the workstation 12. The solid line depiction illustrates the workstation 12 at a position providing access to a user (not illustrated) sitting up in a high bed BR located to the right of the furniture system 10. The dotted line configuration shows a typical presentation for a user (not illustrated) lying down on a low bed BL located to the left of the furniture system 10.

Figure 5:
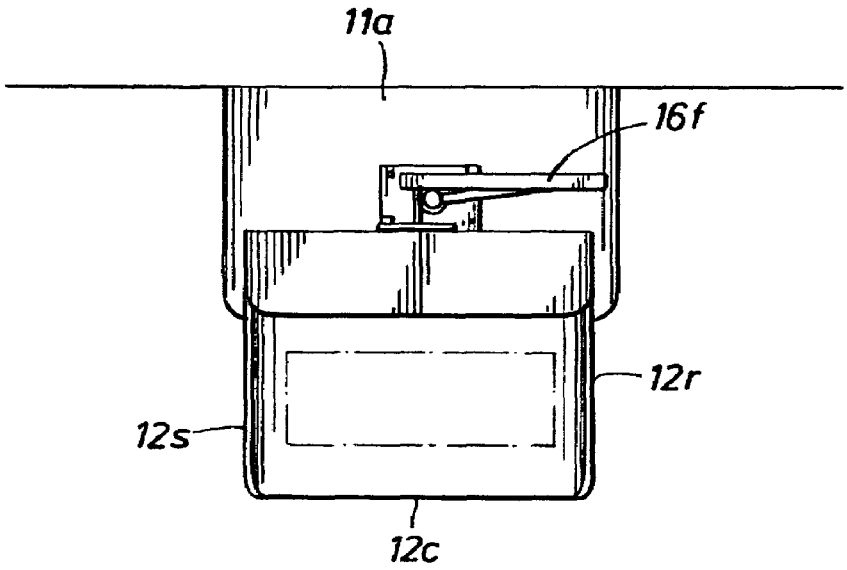
FIG. 5 is a top view illustrating the furniture system of the present invention as it appears with the work support structure opened away from of the presentation support structure.
Figure 6:
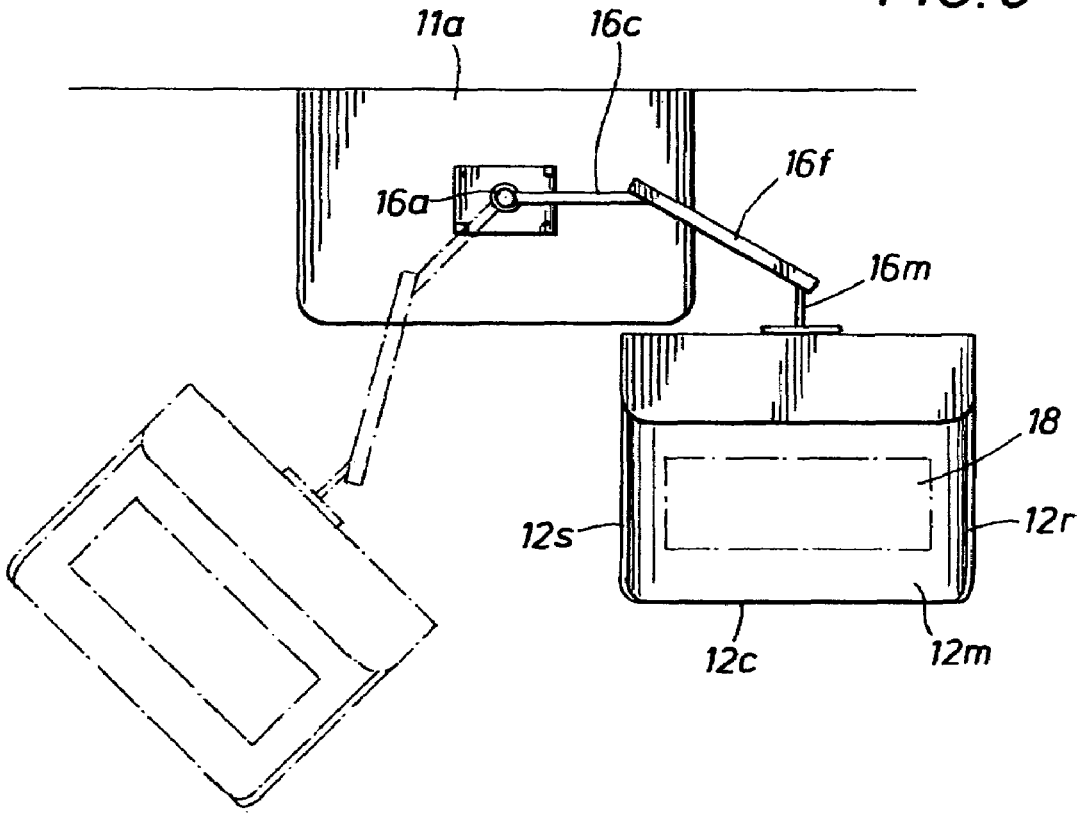
FIG. 6 is a top view illustrating, in solid and dotted line, two positions of the work area and display area assembly adjusted away from the cabinet pedestal mount.

FIGS. 5 and 6 illustrate alternative positions, in a horizontal plane, at which the workstation 12 may be adjusted for a variety of different users and uses.

Figure 7:
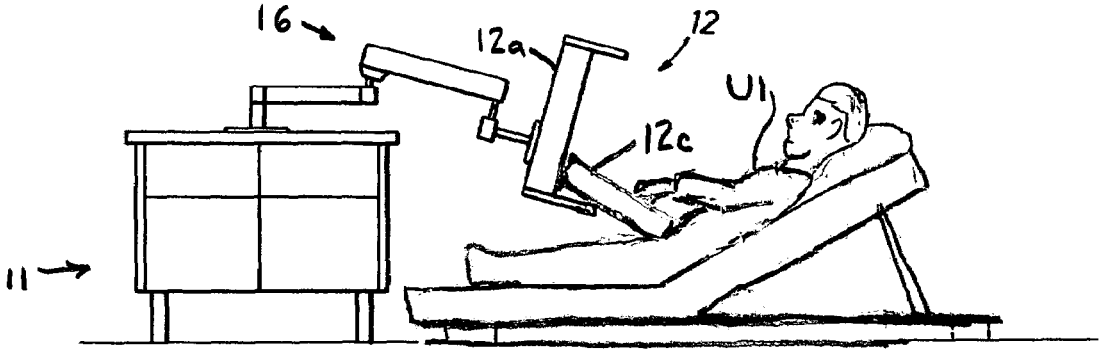
FIG. 7 is a schematic drawing illustrating the working support structure and presentation support structure of the furniture of the present invention being presented to a reclining user.

FIG. 7 illustrates a semi-recumbent user U1 having the workstation 12 elevation adjusted vertically and the plane of the working surface tilted from the horizontal toward the user. As thus adjusted, the furniture system 10 provides optimum placement of the work surface 12*m* and the visual presentation surface 12*a*, for the best working access and visualization by the reclining user.

Figure 8:
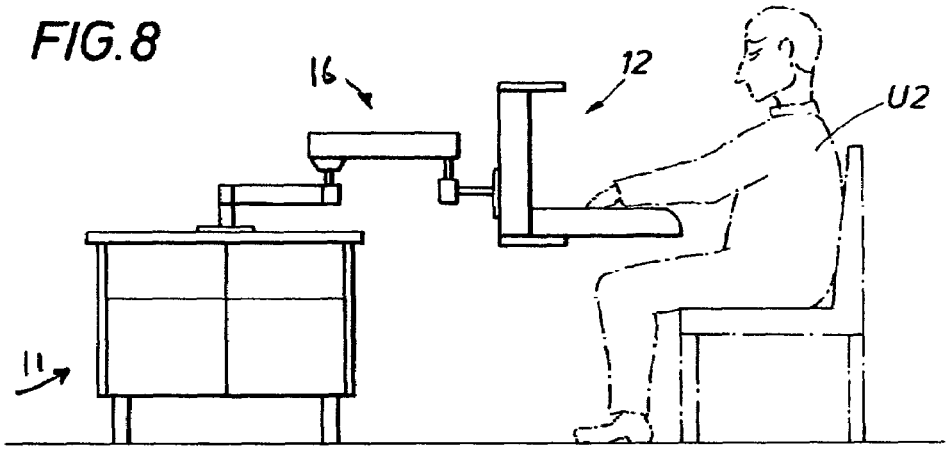
FIG. 8 is a schematic diagram illustrating the work and display areas of the present invention being presented to a seated user.

FIG. 8 illustrates the workstation 12 positioned directly in front of a seated user U2. The vertically disposed presentation surface and the horizontally disposed working surface are positioned relative to the cabinet pedestal 11 to provide the optimum viewing and working for a seated user.

Figure 9:
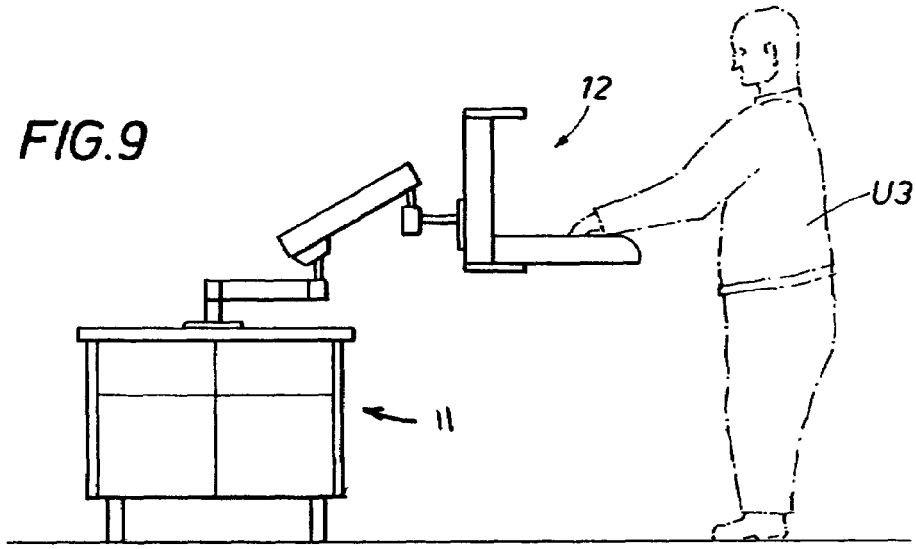
FIG. 9 is a systematic diagram illustrating the work and display areas of the present invention being presented to a standing user.

FIG. 9 illustrates the workstation 12 positioned horizontally and adjusted vertically to provide optimal access and visibility to a standing user U3. It will be appreciated that while certain forms of the invention has been herein described in detail, other forms of the invention may be practiced without departing from the scope and spirit of the present invention.

The invention claimed is:

1. A furniture system, comprising:

a workstation comprising a presentation support structure including a header and a lower shelf, said presentation support structure defining a presentation area between said header and said shelf;

a work support structure movably connected to said presentation support structure, said work support structure having a work side and an ornamental side and being movable from a first position wherein said work side is generally transverse to said presentation area to a second position wherein said work side overlays said presentation area, and;

an adjustable arm having a first end connected to said workstation and a second end connected to a mounting structure, said adjustable arm allowing movement of said workstation between an extended working position away from said mounting structure and a retracted, stored position adjacent to said mounting structure.

2. A furniture system as defined in claim 1, wherein said work support structure is movable relative to a reclining user to present a work surface inclined relative to the horizontal to facilitate user manipulations on said work surface.

3. A furniture system as defined in claim 1, wherein said presentation support structure is movable relative to a reclining user to present material to the user at an angle inclined relative to the vertical to facilitate user access.

4. A furniture system as defined in claim 1 wherein said workstation is adjustable vertically on said arm to accommodate different height users.

5. A furniture system as defined in claim 1 wherein said mounting structure comprises a cabinet pedestal.

6. A furniture system as defined in claim 5 wherein said presentation support structure carries a lighted display.

7. A furniture system as defined in claim 6 wherein said work support structure carries a data entry device.

8. A furniture system as defined in claim 7 wherein said mounting structure comprises a cabinet pedestal.

9. A furniture system as defined in claim 8 wherein said lighted display comprises a video monitor.

10. A furniture system as defined in claim 9 wherein said data entry device comprises a manual keyboard.

11. A furniture system as defined in claim 10 wherein said video monitor and said manual keyboard are electronically connected with electronic data processing equipment housed in said cabinet pedestal.

12. A furniture system as defined in claim 11, wherein:

a major plane of said work support structure is movable into substantially parallel proximity with a major plane of said presentation support structure, a substantially uniform lateral spacing is formed between said major planes of said work support structure and said presentation support structure when said two structures are in substantially parallel proximity, and side extensions are carried at opposing sides of said major plane of said work support structure, said side extensions extending toward said presentation support structure to span a major portion of said lateral spacing between said work support structure and said presentation support structure for providing an ornamental display.

13. A furniture system as defined in claim 12 wherein said ornamental side of said work support structure comprises a substantially continuous curving and planar surface that extends over said side extensions and across said major plane of said work support surface.

14. A furniture system as defined in claim 11 wherein said video monitor is a monitor for a computer screen, said manual keyboard is a keyboard for an electronic computer and said electronic data processing equipment is an electronic computer.

15. A furniture system as defined in claim 8 wherein said data entry device comprises a manual keyboard.

16. A furniture system as defined in claim 5 wherein said work support structure carries a data entry device.

17. A furniture system as defined in claim 5 wherein said cabinet pedestal houses electronic data processing equipment.

18. A furniture system as defined in claim 1 wherein said presentation support structure carries a lighted display.

19. A furniture system as defined in claim 1 wherein said presentation support structure carries a video monitor.

20. A furniture system as defined in claim 1 wherein said work support structure carries a data entry device.

21. A furniture system as defined in claim 1 wherein said workstation retracts to form an enclosed, cabinet-like container.

22. A furniture system as defined in claim 1 wherein said mounting structure is secured to a wall and said workstation defines a recess between said workstation and said wall when in said retracted storage position.

23. A furniture system as defined in claim 1 wherein said mounting structure comprises a cabinet pedestal having a top surface, said second end of said adjustable arm is connected with said top surface and wherein said workstation is adjacent said top surface when in said retracted storage position.

24. A furniture system as defined in claim 23 wherein said cabinet pedestal is secured to a wall and said workstation defines a recess between said workstation and said wall when in said retracted storage position.

25. A furniture system as defined in claim 24 wherein said cabinet pedestal is secured to a wall between two beds and wherein equipment is mounted on said wall in said recess.

26. A furniture system as defined in claim 24 wherein said ornamental side is substantially coplanar with a major frontal surface of said cabinet pedestal when said workstation is in said retracted storage position.

27. A furniture system as defined in claim 26 wherein said workstation retracts to form an enclosed, cabinet-like enclosure.

* * * * *